US007537328B2

(12) United States Patent
Okubo

(10) Patent No.: US 7,537,328 B2
(45) Date of Patent: May 26, 2009

(54) LIQUID EJECTING HEAD AND LIQUID EJECTING APPARATUS

(75) Inventor: Katsuhiro Okubo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 11/741,294

(22) Filed: Apr. 27, 2007

(65) Prior Publication Data

US 2007/0252877 A1 Nov. 1, 2007

(30) Foreign Application Priority Data

Apr. 27, 2006 (JP) ..... 2006-124338

(51) Int. Cl.
*B41J 2/175* (2006.01)

(52) U.S. Cl. ..... 347/93

(58) Field of Classification Search ..... 347/84, 347/85, 86, 87, 92, 93
See application file for complete search history.

(56) References Cited

U.S. PATENT DOCUMENTS 5,546,109 A * 8/1996 Nakano ..... 347/93
6,000,789 A * 12/1999 Takagi et al. ..... 347/86
6,019,465 A * 2/2000 Shinada et al. ..... 347/93
6,736,496 B2 * 5/2004 Hanaoka et al. ..... 347/86
7,192,131 B2 * 3/2007 Gao et al. ..... 347/93

FOREIGN PATENT DOCUMENTS

| | | |
|---|---|---|
| JP | 09-141890 | 3/1997 |
| JP | 11-010904 | 1/1999 |
| JP | 2002-172802 | 6/2002 |
| JP | 2006-076136 | 3/2006 |

* cited by examiner

*Primary Examiner*—Anh T. N. Vo
(74) *Attorney, Agent, or Firm*—Workman Nydegger

(57) ABSTRACT

A liquid ejecting head includes a head main body including a plurality of nozzle openings that eject a liquid; a first supply channel that supplies the liquid from a reservoir unit containing the liquid to the head main body for each nozzle group of the head main body; a first filter disposed at a halfway position of the first supply channel; a filter chamber that is provided as an enlarged width portion for accommodating the first filter; a second supply channel that communicates with the upstream side of the filter chamber of the first supply channel and that communicates with the downstream side of the filter chamber; and a second filter that is provided on an opening of the second supply channel, the opening communicating with the upstream side of the filter chamber of the first supply channel.

14 Claims, 5 Drawing Sheets

LIQUID EJECTING HEAD AND LIQUID EJECTING APPARATUS

BACKGROUND

1. Technical Field

The present invention relates to a liquid ejecting head and a liquid ejecting apparatus, and in particular, to an ink jet recording head and an ink jet recording apparatus that discharge ink as the liquid.

2. Related Art

In an ink jet recording head, which is a typical example of a liquid ejecting head, in general, ink is supplied from an ink reservoir unit filled with ink, such as an ink cartridge, to a head main body, and the ink supplied to the head main body is discharged from a nozzle by driving a pressure generator, such as a piezoelectric element or a heater element.

In such an ink jet recording head, when air bubbles present in ink in an ink cartridge or air bubbles mixed in the ink during attachment or detachment of the ink cartridge are supplied to a head main body, discharge failure due to the presence of the air bubbles, such as dot missing, occurs. In order to solve this problem, in a known ink jet recording apparatus, a filter for removing, for example, air bubbles in ink is provided in an ink channel disposed between an ink cartridge and an ink jet recording head, a part of the ink channel being formed by an ink supply needle, which is inserted into the ink cartridge (see, for example, JP-A-11-10904, p. 2 and p. 3, FIG. 1).

The formation of this filter can prevent air bubbles from flowing in a head main body. However, it is difficult to discharge air bubbles accumulated in the filter section.

To solve this problem, another known ink jet recording apparatus includes a bypass channel for bypassing a filter chamber disposed upstream of a filter and a supply channel disposed downstream of the filter so as to discharge air bubbles accumulated in the filter section through the bypass channel (see, for example, JP-A-9-141890, p. 3 and p. 4, FIGS. 2 to 4).

However, in the structure disclosed in JP-A-9-141890, ink also flows through the bypass channel without passing through the filter. Accordingly, foreign matter such as contaminant matter cannot be trapped by the filter, resulting in a problem of clogging of a nozzle, or the like. In addition, when large foreign matter flows in the bypass channel, the bypass channel clogs and does not function. Furthermore, the bypass channel described in JP-A-9-141890 is used for discharging air bubbles. Accordingly, in a state in which air bubbles are accumulated on the filter, supply failure of ink occurs, and the frequency of discharging the air bubbles accumulated on the filter cannot be reduced. Therefore, unnecessary waste of the ink cannot be reduced.

These problems occur not only in ink jet recording heads that discharge ink but also in other liquid ejecting heads that eject a liquid other than ink.

SUMMARY

An advantage of some aspects of the invention is that it provides a liquid ejecting head and a liquid ejecting apparatus in which discharge failure due to the presence of an air bubble is prevented to reduce unnecessary waste of a liquid.

According to a first aspect of the invention, a liquid ejecting head includes a head main body including a plurality of nozzle openings that eject a liquid; a supply channel that supplies the liquid from a reservoir unit containing the liquid to the head main body for each nozzle group of the head main body; a filter disposed at a halfway position of the supply channel; a filter chamber that is provided as an enlarged width portion for accommodating the filter; a sub-supply channel that communicates with the upstream side of the filter chamber of the supply channel and that communicates with the downstream side of the filter chamber; and a sub-filter that is provided on an opening of the sub-supply channel, the opening communicating with the upstream side of the filter chamber of the supply channel. According to the first aspect of the invention, in the case where air bubbles are accumulated on the filter, even when the air bubbles are not discharged before supply failure of the liquid or discharge failure of the liquid by the head main body occurs, the liquid can be supplied to the head main body through the sub-supply channel. Accordingly, the supply failure of the liquid or discharge failure of the liquid can be prevented. Furthermore, the liquid can be supplied to the head main body through the sub-supply channel even in a state in which air bubbles are accumulated on the filter. Accordingly, the frequency of a suction operation for discharging the air bubbles on the filter can be decreased, thereby reducing unnecessary waste of the liquid. Furthermore, foreign matter mixed in the liquid flowing through the sub-supply channel, such as fine air bubbles and contaminant matter, can be trapped by the sub-filter, thus preventing the foreign matter from being mixed in the head main body.

In the liquid ejecting head, the sub-filter is preferably disposed so that a direction intersecting the direction orthogonal to the direction in which the liquid flows through the supply channel is the surface direction of the sub-filter. In the liquid ejecting head, the sub-filter is preferably disposed so that the surface direction of the sub-filter is along the direction in which the liquid flows through the supply channel. In this case, air bubbles accumulated on the sub-filter can be reduced in number. Furthermore, when no air bubbles are accumulated on the filter, flow of the liquid in the sub-supply channel can be prevented.

In the liquid ejecting head, the area of the sub-filter is preferably smaller than the area of the filter. In the liquid ejecting head, the area of the sub-filter is preferably in the range of ⅓ to ¼ of the cross-sectional area of the supply channel located upstream of the filter. In this case, by specifying the area of the sub-filter, when no air bubbles are accumulated on the filter, flow of the liquid in the sub-supply channel can be prevented.

Preferably, the liquid ejecting head further includes an opening/closing member that freely opens and closes the opening of the sub-supply channel on which the sub-filter is provided, that opens the opening of the sub-supply channel when the flow rate of the liquid flowing through the supply channel is decreased, and that closes the opening of the sub-supply channel when the flow rate of the liquid is increased. In this case, when no air bubbles are accumulated on the filter, flow of the liquid in the sub-supply channel can be prevented.

The opening/closing member is preferably a cover which has a plate shape so as to cover the sub-filter, an end of which is fixed to the upstream side of the opening edge of the sub-supply channel, the opening having the sub-filter thereon, and another end of which is a free end and is provided so as to project in the radial direction of the supply channel. In this case, the sub-supply channel can be opened and closed with the cover in accordance with the flow rate of the liquid flowing through the supply channel without using a complex device.

In the liquid ejecting head, the sub-supply channel preferably communicates with a reservoir functioning as a common liquid chamber of a plurality of pressure-generating chambers communicating with the nozzle openings provided in the head main body. In this case, the dynamic pressure when the liquid is supplied to the reservoir can be decreased.

According to a second aspect of the invention, a liquid ejecting apparatus includes the liquid ejecting head according to the first aspect of the invention. In the liquid ejecting apparatus, ejecting failure of a liquid can be prevented and unnecessary waste of the liquid can be reduced.

Preferably, the liquid ejecting apparatus further includes a suction unit that sucks the liquid in the supply channel and the sub-supply channel from the nozzle openings. In this case, air bubbles on the filter and the sub-filter can be sucked with the suction unit to discharge the air bubbles. Accordingly, ejecting failure of the liquid can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will now be described in detail on the basis of embodiments.

First Embodiment

Figure 1:
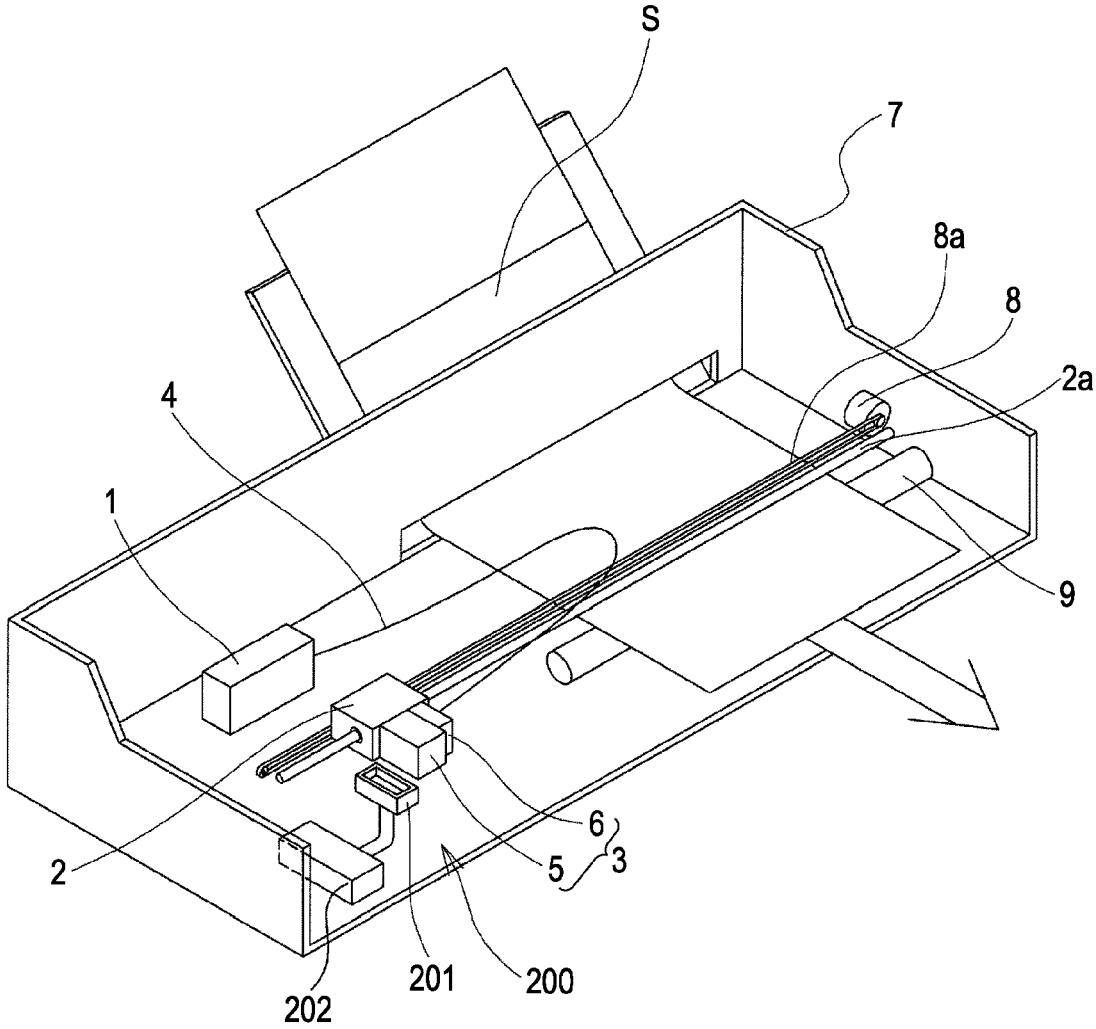
FIG. 1 is a schematic perspective view of an ink jet recording apparatus according to a first embodiment of the invention.

FIG. 1 is a schematic perspective view of an ink jet recording apparatus according to a first embodiment of the invention. As shown in FIG. 1, in this embodiment, ink supplied from a reservoir unit 1 containing the ink is supplied to an ink jet recording head 3 mounted on a carriage 2 through a supply tube 4. The ink jet recording head 3 includes a head main body 5 including nozzle openings for discharging the ink and a filter unit 6 connected to the supply tube 4 for supplying the ink from the reservoir unit 1 to the head main body 5.

The carriage 2 mounting the above ink jet recording head 3 is provided in a carriage shaft 2*a* attached to an apparatus main body 7 so as to freely move in the axial direction.

A driving force of a drive motor 8 is transmitted to the carriage 2 through a plurality of gears (not shown) and a timing belt 8*a*, whereby the carriage 2 mounting the ink jet recording head 3 is moved along the carriage shaft 2*a*. A platen 9 is provided along the carriage shaft 2*a* in the apparatus main body 7. A recording sheet S, such as paper, used as a recording medium and fed by a paper-feeding roller (not shown) or the like is transported while rolling on the platen 9.

In such an ink jet recording apparatus, the ink is discharged by the head main body 5 of the ink jet recording head 3 while the carriage 2 is moved along the carriage shaft 2*a*, thereby printing is performed on the recording sheet S.

A suction unit 200 is provided at the lateral side of the platen 9, that is, at an end of the moving direction of the carriage 2. The suction unit 200 includes a cap 201 that is provided so as to face nozzles of the ink jet recording head 3, and a suction pump 202 connected to the cap 201. A cleaning operation for sucking the ink from the nozzles is performed at a predetermined timing. The cap 201 caps the nozzle surface of the ink jet recording head 3 that is in a printing stand-by mode for a predetermined period or more to prevent drying of the nozzles.

Figure 2:
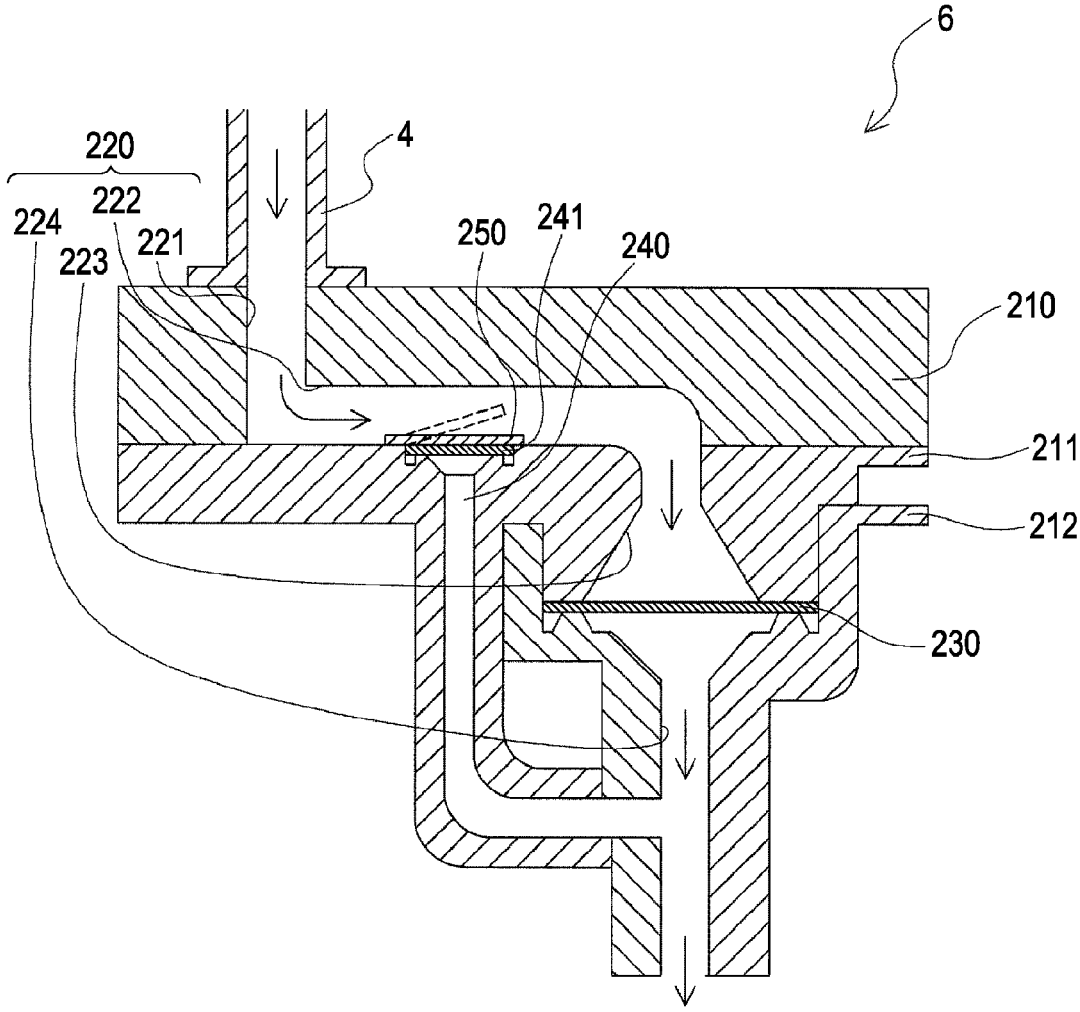
FIG. 2 is cross-sectional view of a filter unit according to the first embodiment of the invention.
Figure 3:
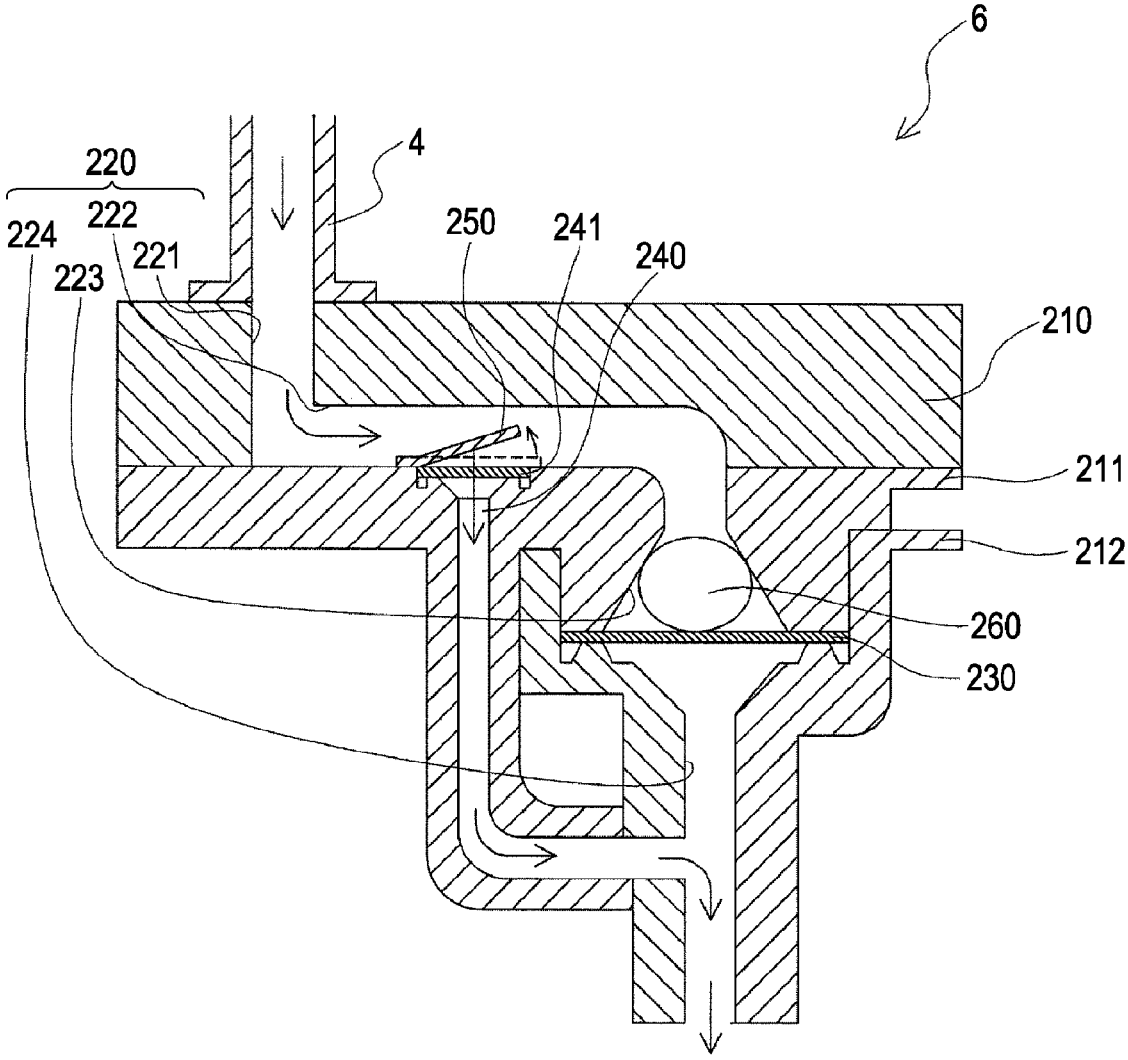
FIG. 3 is cross-sectional view of a filter unit according to the first embodiment of the invention.

The filter unit 6 of the ink jet recording head 3 will now be described with reference to FIGS. 2 and 3. FIGS. 2 and 3 are cross-sectional views of a filter unit. As shown in FIG. 2, the filter unit 6 includes a first channel-forming member 210 to which an end of the supply tube 4, another end of which is connected to the reservoir unit 1, is connected, a second channel-forming member 211 joined to the first channel-forming member 210, and a third channel-forming member 212 joined to the second channel-forming member 211 and connected to the head main body 5.

A supply channel 220 for supplying ink from the reservoir unit 1 (supply tube 4) to the head main body 5 is provided in the first channel-forming member 210, the second channel-forming member 211, and the third channel-forming member 212.

The first channel-forming member 210 includes an input port 221 and an input channel 222. The input port 221 penetrates in the thickness direction of the first channel-forming member 210, and the supply tube 4 is connected to the input port 221. The input channel 222 is open at the side opposite the surface of the input port 221 to which the supply tube 4 is connected, and has a recessed shape one end of which communicates with the input port 221.

The second channel-forming member 211 is joined to the surface on which the input channel 222 of the first channel-forming member 210 is open, and seals one face of the input channel 222. The second channel-forming member 211 includes a filter chamber 223 penetrating in the thickness direction. The filter chamber 223 communicates with an end of the input channel 222, the end being opposite another end communicating with the input port 221 of the input channel 222. This filter chamber 223 is formed so as to dispose a filter 230 between the second channel-forming member 211 and the third channel-forming member 212. The filter chamber 223 is provided as an enlarged width portion in which the inner diameter diverges toward an output channel 224 provided in the third channel-forming member 212 described below so that the filter 230 can have a large area to minimize the resistance when the ink passes through the filter 230.

The third channel-forming member 212 is joined to the surface on which the filter chamber 223 of the second channel-forming member 211 is open. The third channel-forming member 212 includes the output channel 224 one end of which is open to an area facing the filter chamber 223. Another end of the output channel 224 is connected to the head main body 5.

The filter 230 is held in an area facing the filter chamber 223, the area disposed between the third channel-forming member 212 and the second channel-forming member 211. That is, the filter surface of the filter 230 is disposed in a direction orthogonal to the direction in which the ink flows through the input channel 222 and the output channel 224. The filter 230 has a plurality of micropores formed by, for example, finely weaving metal wires and is fixed to the third channel-forming member 212 by welding.

In this embodiment, the input port 221, the input channel 222, the filter chamber 223, and the output channel 224 of the first channel-forming member 210, the second channel-forming member 211, and the third channel-forming member 212 constitute the supply channel 220 for supplying the ink from the reservoir unit 1 to the head main body 5. That is, the ink supplied from the reservoir unit 1 through the supply tube 4 is supplied to the head main body 5 through the input port 221, the input channel 222, the filter chamber 223, the filter 230, and the output channel 224.

The second channel-forming member 211 further includes a sub-supply channel 240. The sub-supply channel 240 communicates with the upstream side of the filter chamber 223 of the supply channel 220 and communicates with the downstream side of the filter chamber 223 of the supply channel 220. That is, the sub-supply channel 240 communicates with the input channel 222 and communicates with the output channel 224.

A sub-filter 241 is provided on the opening of the sub-supply channel 240, the opening communicating with the input channel 222, so that a direction intersecting the direction orthogonal to the direction in which the ink flows through the supply channel 220 is the surface direction of the sub-filter 241. In this embodiment, the sub-supply channel 240 is provided in a direction orthogonal to the input channel 222 and is open on a surface sealing the input channel 222 of the second channel-forming member 211. Accordingly, the opening surface of the sub-supply channel 240, the opening surface opening to the input channel 222, is disposed along a direction in which the ink flows through the supply channel 220. In addition, the sub-filter 241 covering the opening is provided in an area facing the opening of the sub-supply channel 240. Therefore, the sub-filter 241 is disposed so that the surface direction of the sub-filter 241 is along the direction in which the ink flows through the supply channel 220.

The area of the sub-filter 241 provided on the sub-supply channel 240 is smaller than the area of the filter 230 provided in the supply channel 220. Accordingly, the filter 230 of the supply channel 220 can be used as a filter for trapping an air bubble, and the sub-filter 241 can be used as a filter for supplying the ink when an air bubble is trapped on the filter 230. The area of the sub-filter 241 is preferably in the range of about ⅓ to ¼ of the cross-sectional area of the input channel 222 of the supply channel 220.

The sub-filter 241 has a plurality of micropores formed by, for example, finely weaving metal wires and is fixed to the second channel-forming member 211 by welding.

A cover 250 is provided at the opening of the input channel 222 communicating with the sub-supply channel 240 as an opening/closing member for opening and closing the opening. The cover 250 is a plate made of a metal, a resin, or the like and covers the sub-filter 241. One end of the cover 250 is fixed at the upstream side of the opening edge of the input channel 222 communicating with the sub-supply channel 240, and another end of the cover 250 is a free end. The cover 250 is provided so that the free end projects in the radial direction of the supply channel 220.

In this filter unit 6, as shown in FIG. 2, the ink supplied from the reservoir unit 1 through the supply tube 4 is supplied to the head main body 5 through the supply channel 220. In this case, the cover 250 is pressed in accordance with the flow rate of the ink flowing through the supply channel 220. Consequently, the shape of the cover 250 is changed to cover the sub-filter 241. The opening of the sub-supply channel 240 is closed, thus preventing the ink from flowing through the sub-supply channel 240. In this case, as shown in FIG. 3, air bubbles mixed in the ink are trapped by the filter 230 and accumulate on the filter 230 to form an air bubble 260. When the size of the air bubble 260 trapped on the filter 230 increases, the amount of ink supplied through the supply channel 220 is decreased by the presence of the air bubble 260, and the flow rate of the ink passing through the supply channel 220 is decreased. Consequently, the pressure pressing the cover 250 is decreased. Accordingly, the shape of the cover 250 is changed so that one end of the cover 250 projects toward the center of the supply channel 220, thereby opening the sub-supply channel 240. In this case, the ink supplied from the supply tube 4 is supplied downstream of the filter chamber 223 of the supply channel 220 through the sub-filter 241 and the sub-supply channel 240 without passing through the filter chamber 223.

When the air bubble 260 trapped on the filter 230 is discharged, the cover 250 of the sub-supply channel 240 is closed by suction supplied by the suction unit 200, and a sufficient negative pressure is generated above and below the filter 230. Therefore, the discharging of the air bubble 260 is not disturbed.

As described above, in the case where air bubbles accumulate on the filter 230 to form an air bubble 260, even when the air bubble 260 is not discharged before supply failure of the ink or discharge failure of the ink by the head main body 5 occurs, the ink can be supplied to the head main body 5 through the sub-supply channel 240. Accordingly, the supply failure of the ink or discharge failure of the ink can be prevented. Furthermore, the ink can be supplied to the head main body 5 even in a state in which the air bubble 260 is trapped on the filter 230. Accordingly, the frequency of suction of the air bubble 260 by the suction unit 200 can be decreased, thereby reducing unnecessary waste of the ink.

In addition, the sub-filter 241 is disposed so that the direction of the surface thereof is along the direction in which the ink flows through the supply channel 220. Accordingly, as shown in FIG. 3, even when the ink passes on the sub-filter 241, air bubbles negligibly accumulate on the sub-filter 241. Accordingly, supply failure of the ink can be prevented, and discharge failure of the ink can also be prevented.

If the sub-filter 241 is provided at a halfway position of the sub-supply channel 240 or the downstream side thereof, air bubbles easily accumulate on the sub-filter 241. In such a case, the air bubbles accumulated on the sub-filter 241 cause supply failure of the ink and discharge failure of the ink. Therefore, the sub-filter 241 is preferably provided on the opening of the sub-supply channel 240, the opening facing the input channel 222.

During suction by the suction unit 200 of this embodiment, ink in the supply channel 220 and the sub-supply channel 240 is sucked. Accordingly, air bubbles accumulated on the filter 230 of the supply channel 220 are sucked, and fine air bubbles disposed on the sub-filter 241 of the sub-supply channel 240 can also be sucked at the same time.

Figure 4:
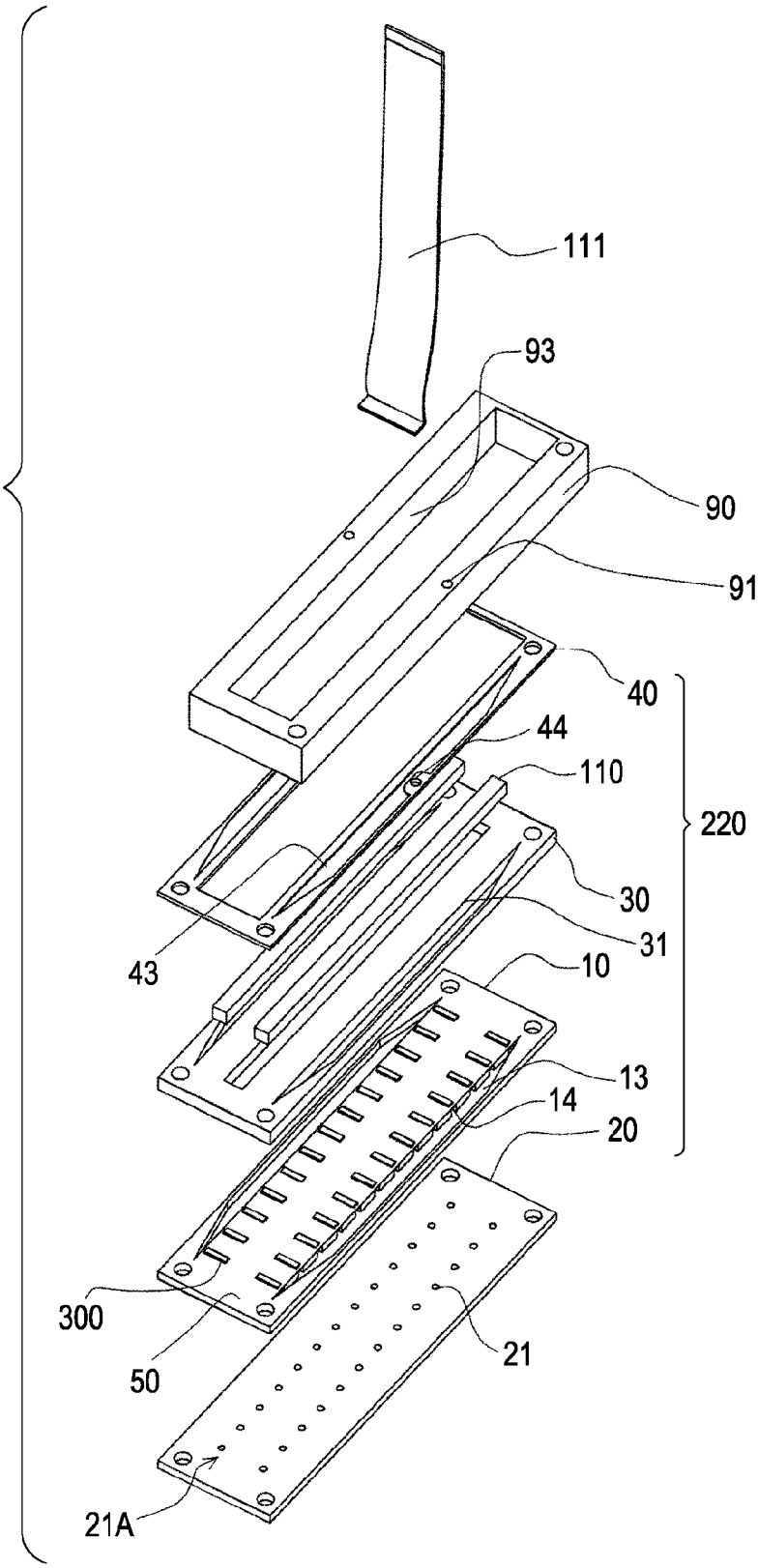
FIG. 4 is an exploded perspective view of a head main body according to the first embodiment of the invention.
Figure 5:
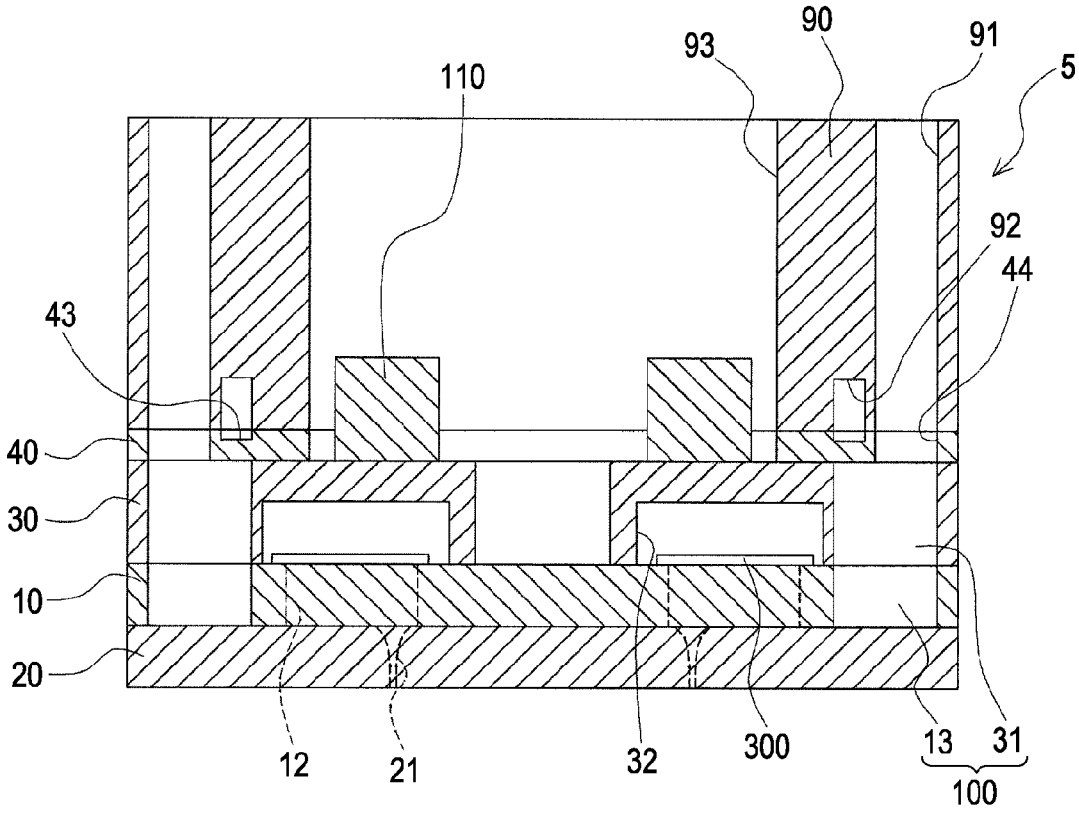
FIG. 5 is a cross-sectional view of the head main body according to the first embodiment of the invention.

An example of the head main body 5 of the ink jet recording head 3 will now be described. FIG. 4 is an exploded perspective view of a head main body, and FIG. 5 is a cross-sectional view of the head main body. As shown in FIGS. 4 and 5, in this embodiment, a channel-forming substrate 10 constituting the head main body 5 is composed of a single-crystal silicon substrate, and an elastic film 50 made of silicon dioxide is formed in advance on a surface of the channel-forming substrate 10 by thermal oxidation. Pressure-generating chambers 12 sectioned by a plurality of partition walls are formed on another surface of the channel-forming substrate 10 by anisotropic etching. These pressure-generating chambers 12 are arranged in parallel in two rows in the width direction of the channel-forming substrate 10. A communication section 13 is provided on the outside of each row of the pressure-generating chambers 12 in the longitudinal direction. The communication section 13 communicates with a reservoir section 31, which is provided on a protective substrate 30 described below, and constitutes a reservoir 100 functioning as a common ink chamber of the pressure-generating chambers 12.

The communication section 13 communicates with one end portions in the longitudinal direction of the pressure-generating chambers 12 via ink supply channels 14.

A nozzle plate 20 having nozzle openings 21 drilled therein is fixed to the orifice side of the channel-forming substrate 10, with, for example, an adhesive or a thermal welding film therebetween. Each of the nozzle openings 21 communicates with the corresponding pressure-generating chamber 12 at the side opposite the ink supply channel 14. More specifically, in this embodiment, two nozzle arrays 21A each having nozzle openings 21 arranged in a line are provided in one head main body 5.

Meanwhile, piezoelectric elements 300 are provided on the surface opposite the orifice side of the channel-forming substrate 10. Each of the piezoelectric elements 300 is formed by sequentially laminating an insulator film made of zirconium oxide, a lower electrode film made of a metal, a piezoelectric layer made of lead zirconate titanate (PZT) or the like, and an upper electrode film made of a metal on the elastic film 50 by deposition and lithography. The protective substrate 30 having the reservoir sections 31 constituting at least a part of the reservoir 100 is joined on the channel-forming substrate 10 having the piezoelectric elements 300 thereon. In this embodiment, each of the reservoir sections 31 penetrates the protective substrate 30 in its thickness direction and is formed across the width direction of the pressure-generating chambers 12. As described above, the reservoir section 31 communicates with the communication section 13 of the channel-forming substrate 10 and constitutes the reservoir 100 functioning as a common ink chamber of the pressure-generating chambers 12.

A piezoelectric element-holding section 32 is provided in an area of the protective substrate 30 facing the piezoelectric element 300. This piezoelectric element-holding section 32 forms a space having dimensions such that the piezoelectric element-holding section 32 does not hamper the movement of the piezoelectric element 300. Examples of the material of the protective substrate 30 include glass, ceramics, metals, and plastics. Preferably, the material of the protective substrate 30 has approximately the same coefficient of thermal expansion as that of the channel-forming substrate 10. In this embodiment, a single-crystal silicon substrate, which is the same material as that of the channel-forming substrate 10, is used for the protective substrate 30.

Drive ICs 110 for driving the piezoelectric elements 300 are provided on the protective substrate 30. Each terminal of the drive ICs 110 is connected to a lead wiring extended from individual electrodes of each piezoelectric element 300 with a bonding wire or the like (not shown). The terminals of the drive ICs 110 are connected to the outside through external wiring 111, such as a flexible print cable (FPC) as shown in FIG. 4, and receive various signals, such as print signals, from the outside through the external wiring 111.

A compliance substrate 40 is joined on the protective substrate 30. Ink inlets 44 for supplying ink to the reservoirs 100 are formed in areas of the compliance substrate 40 facing the reservoirs 100 by penetrating the compliance substrate 40 in its thickness direction. An area other than the ink inlet 44 in the area of the compliance substrate 40 facing the reservoir 100 constitutes a flexible portion 43 formed so as to have a small thickness. The reservoir 100 is sealed by the flexible portion 43. Compliance is provided inside the reservoir 100 by this flexible portion 43.

Furthermore, a head case 90 having ink supply communication paths 91 is provided on the compliance substrate 40. Each of the ink supply communication paths 91 communicates with the ink inlet 44 and the supply channel 220 of the filter unit 6 to supply the ink from the filter unit 6 to the ink inlet 44. The head case 90 includes recesses 92 disposed on areas facing the corresponding flexible portion 43, and thus, flexible distortion of the flexible portion 43 is appropriately performed. The head case 90 also includes a drive IC-holding section 93 formed by penetrating the head case 90 in its thickness direction. The drive IC-holding section 93 is formed at a position facing the drive ICs 110 provided on the protective substrate 30. The external wiring 111 penetrates the drive IC-holding section 93 and is connected to the drive ICs 110.

In the head main body 5 of this embodiment, ink supplied from the reservoir unit 1 is introduced to the ink inlet 44 through the supply tube 4, the supply channel 220 of the filter unit 6, and the ink supply communication path 91 of the head case 90, and the inside ranging from the reservoir 100 to the nozzle opening 21 is filled with the ink. Subsequently, a voltage is applied to each piezoelectric element 300 corresponding to the pressure-generating chamber 12 on the basis of recording signals transmitted from the drive IC 110, thereby flexibly deforming the elastic film 50 and the piezoelectric element 300. Consequently, the pressure in each pressure-generating chamber 12 is increased, and an ink droplet is discharged from the nozzle opening 21.

In the filter unit 6 of this embodiment, one supply channel 220 is provided for each nozzle array 21A, and one sub-supply channel 240 is provided for each supply channel 220. That is, in this embodiment, since the head main body 5 includes two nozzle arrays 21A, two supply channels 220 and two sub-supply channels 240 are provided in the filter unit 6. It is sufficient that one supply channel 220 of the filter unit 6 is provided for each group of a plurality of nozzle openings 21, and the number of the supply channels 220 is not particularly limited to the above. At least one sub-supply channel 240 is provided for each supply channel 220. Therefore, two or more sub-supply channels 240 may be provided for each supply channel 220.

OTHER EMBODIMENTS

An embodiment of the invention has been described, but the fundamental structure of the invention is not limited to the embodiment described above. For example, in the above-described first embodiment, the cover 250 is provided as an opening/closing member for opening and closing the sub-supply channel 240 in accordance with the flow rate of the ink flowing through the supply channel 220. The opening/closing member is not particularly limited to the cover 250. For example, the opening/closing member may be composed of a measuring device which measures the flow rate of the ink flowing through the supply channel 220, and a valve member, such as a valve, which opens and closes the sub-supply channel 240 on the basis of the measurement result of the measuring device by, for example, an electromagnetic force or a driving force obtained by a drive motor. The opening/closing member is not essential. The sub-filter 241 is disposed so that the surface direction of the filter surface is along the flow of the ink in the supply channel 220, and the filter surface of the sub-filter 241 has a channel resistance. Accordingly, usually, when no air bubbles are accumulated on the filter 230, the ink negligibly flows in the sub-supply channel 240. Only when air bubbles are accumulated on the filter 230, the ink can be made to flow in the sub-supply channel 240.

In the first embodiment, the sub-filter 241 is disposed so that the surface direction of the filter surface is along the direction in which the ink flows through the supply channel 220. However, the surface direction of the filter surface of the sub-filter 241 is not particularly limited as long as the surface direction is a direction intersecting the direction orthogonal to the direction in which the ink flows through the supply channel 220.

Furthermore, in the first embodiment, both ends of the sub-supply channel communicate with the supply channel so that the ink flowing through the sub-supply channel returns to the supply channel downstream of the filter, but the structure is not particularly limited thereto. For example, the sub-supply channel may communicate with the reservoir 100 of the head main body 5 independently of the supply channel. This structure can reduce the dynamic pressure.

In the first embodiment, a thin-film piezoelectric element prepared by laminating a lower electrode film, a piezoelectric layer, and an upper electrode film by deposition and lithography is used as the piezoelectric element 300 of the head main body 5, but the piezoelectric element 300 is not particularly limited thereto. Examples thereof include a thick-film piezoelectric element formed by, for example, laminating green sheets, and a longitudinal vibration piezoelectric element prepared by alternately laminating a piezoelectric material and an electrode-forming material so as to expand and contract in the axial direction. Alternatively, an element in which an ink droplet is discharged by a bubble formed by heat generated from a heater element or the like may also be used.

In the first embodiment, a description has been made using an ink jet recording head as an example of a liquid ejecting head. The invention is widely applied to general liquid ejecting heads and can also be applied to liquid ejecting heads that eject a liquid other than ink. Examples of the other liquid ejecting heads include various recording heads used in an image-recording apparatus, such as a printer, colorant-ejecting heads used for producing a color filter of a liquid crystal display or the like, electrode material-ejecting heads used for forming an electrode of an organic electroluminescent (EL) display or a face emission display (FED), and biological organic substance-ejecting heads used for producing a biochip.

What is claimed is:

1. A liquid ejecting head comprising:

a head main body including a plurality of nozzle openings that eject a liquid;

a first supply channel that supplies the liquid from a reservoir unit containing the liquid to the head main body for each nozzle group of the head main body;

a first filter disposed at a halfway position of the first supply channel;

a filter chamber that is provided as an enlarged width portion for accommodating the first filter;

a second supply channel that communicates with the upstream side of the filter chamber of the first supply channel and that communicates with the downstream side of the filter chamber; and a second filter that is provided on an opening of the second supply channel, the opening communicating with the upstream side of the filter chamber of the first supply channel;

wherein the second filter is disposed so that the surface direction of the second filter is along the direction in which the liquid flows through the first supply channel.

2. The liquid ejecting head according to claim 1, wherein the second filter is disposed so that a direction intersecting the direction orthogonal to the direction in which the liquid flows through the supply channel is the surface direction of the second filter.

3. The liquid ejecting head according to claim 1, wherein the area of the second filter is smaller than the area of the first filter.

4. The liquid ejecting head according to claim 3, wherein the area of the second filter is in the range of ⅓ to ¼ of the cross-sectional area of the supply channel located upstream of the first filter.

5. The liquid ejecting head according to claim 1, further comprising:

an opening/closing member that freely opens and closes the opening of the second supply channel on which the second filter is provided, that opens the opening of the second supply channel when the flow rate of the liquid flowing through the first supply channel is decreased, and that closes the opening of the second supply channel when the flow rate of the liquid is increased.

6. The liquid ejecting head according to claim 5, wherein the opening/closing member is a cover which has a plate shape so as to cover the second filter, an end of which is fixed to the upstream side of the opening edge of the second supply channel, the opening having the second filter thereon, and another end of which is a free end and is provided so as to project in the radial direction of the first supply channel.

7. The liquid ejecting head according to claim 6, wherein the second supply channel communicates with a reservoir functioning as a common liquid chamber of a plurality of pressure-generating chambers communicating with the nozzle openings provided in the head main body.

8. A liquid ejecting apparatus comprising the liquid ejecting head according to claim 7.

9. The liquid ejecting apparatus according to claim 8, further comprising a suction unit that sucks the liquid in the first supply channel and the second supply channel from the nozzle openings.

10. A liquid ejecting head comprising:

a head main body including a plurality of nozzle openings that eject a liquid;

a first supply channel that supplies the liquid from a reservoir unit containing the liquid to the head main body for each nozzle group of the head main body;

a first filter disposed at a halfway position of the first supply channel;

a filter chamber that is provided as an enlarged width portion for accommodating the first filter;

a second supply channel that communicates with the upstream side of the filter chamber of the first supply channel and that communicates with the downstream side of the filter chamber;

a second filter that is provided on an opening of the second supply channel, the opening communicating with the upstream side of the filter chamber of the first supply channel; and an opening/closing member that freely opens and closes the opening of the second supply channel on which the second filter is provided, that opens the opening of the second supply channel when the flow rate of the liquid flowing through the first supply channel is decreased, and that closes the opening of the second supply channel when the flow rate of the liquid is increased.

11. The liquid ejecting head according to claim 10, wherein the opening/closing member is a cover which has a plate shape so as to cover the second filter, an end of which is fixed to the upstream side of the opening edge of the second supply channel, the opening having the second filter thereon, and another end of which is a free end and is provided so as to project in the radial direction of the first supply channel.

12. The liquid ejecting head according to claim 11, wherein the second supply channel communicates with a reservoir functioning as a common liquid chamber of a plurality of pressure-generating chambers communicating with the nozzle openings provided in the head main body.

13. A liquid ejecting apparatus comprising the liquid ejecting head according to claim 12.

14. The liquid ejecting apparatus according to claim 13, further comprising a suction unit that sucks the liquid in the first supply channel and the second supply channel from the nozzle openings.

* * * * *